US008985378B2

(12) United States Patent
Wan et al.

(10) Patent No.: US 8,985,378 B2
(45) Date of Patent: Mar. 24, 2015

(54) COSMETIC COMPACT

(71) Applicant: Charles Chang, Wayne, NJ (US)

(72) Inventors: Zicai Wan, Shenzhen (CN); Ralph DeVito, Oxford, CT (US)

(73) Assignee: Charles Chang, Wayne, NJ (US)

( * ) Notice: Subject to any disclaimer, the term of this patent is extended or adjusted under 35 U.S.C. 154(b) by 231 days.

(21) Appl. No.: 13/573,602

(22) Filed: Sep. 27, 2012

(65) Prior Publication Data

US 2014/0084010 A1 Mar. 27, 2014

Related U.S. Application Data

(60) Provisional application No. 61/626,615, filed on Sep. 29, 2011.

(51) Int. Cl.
*A45D 33/00* (2006.01)
*A45D 40/24* (2006.01)
*A45D 33/20* (2006.01)

(52) U.S. Cl.
CPC ..... *A45D 33/006* (2013.01); *A45D 40/24* (2013.01); *A45D 33/20* (2013.01)
USPC ..... 220/521; 220/4.22; 220/525; 220/528; 220/534; 220/544; 220/549; 220/810; 220/811; 220/812; 220/813; 220/830; 220/833; 220/835; 220/844; 220/849

(58) Field of Classification Search
CPC ... A45D 33/00; A45D 33/008; A45D 33/006; A45D 33/20; A45D 40/24
USPC ..... 220/4.22, 521, 525, 528, 529, 534, 544, 220/549, 810, 811, 812, 813, 830, 833, 835, 220/844, 849
See application file for complete search history.

(56) References Cited

FOREIGN PATENT DOCUMENTS

WO WO2005028685 * 3/2005 ..... A45D 33/008

* cited by examiner

*Primary Examiner* — Elizabeth Volz
(74) *Attorney, Agent, or Firm* — K. Gibner Lehmann

(57) ABSTRACT

A cosmetic compact having an expansive base member containing a series of upwardly-facing product wells to accommodate one or more cosmetic items, the compact further having a cover member, and having a shuttle piece interposed between the base member and cover member. The various parts have cooperating slide components for permitting relative movement of the members in four opposed directions. A versatile, four way slide compact construction is thus made possible.

15 Claims, 21 Drawing Sheets

COSMETIC COMPACT

The present application claims U.S. priority of our corresponding U.S. Provisional Application Ser. No. 61/626,615 filed Sep. 29, 2011, entitled COSMETIC COMPACT.

BACKGROUND OF THE INVENTION

1. Field of the Invention

This invention relates generally to cosmetic compacts, and more particularly to compacts of the type that are capable of storing and dispensing an unusually large variety of different cosmetic products in a single, easy-to-use package.

2. Description of the Related Art Including Information Disclosed Under 37 CFR 1.97-1.99

The following references are hereinbelow listed as being considered a representative sampling of prior art in the field to which the present invention pertains:

| | |
|---|---|
| U.S. Pat. Nos.: | 1,453,563 |
| | 1,698,266 |
| | 2,104,104 |
| | 3,828,802 |
| | 4,944,402 |
| | 5,025,817 |
| | 7,828,000 |
| U.S. Patent Application Publication No.: | 2010/0319723 |

In particular, the earliest U.S. Pat. No. 1,453,563, illustrates a vanity case which presents a first compartment constituted as a pull-out drawer slidably received in a base, and a second compartment formed in the base itself, with a hinged lid and a clasp at the front of the lid. This prior art device is considered by applicants, to be exemplary of a very large number of subsequently developed cosmetic containers.

U.S. Pat. No. 1,698,266 discloses a two compartment container, wherein the compartments are arranged side-by-side in a base with a slidable closure member. A cup-like recess is formed in upper portion of the closure member, and a secondary closure member is arranged to fit onto the first. The recess and secondary closure member constitute a third compartment for storage of a cosmetic substance.

U.S. Pat. No. 2,104,104 shows a cosmetic compact utilizing a container with a slide cover, and further including a flap on the cover, which can be opened to reveal a mirror. The unit is made up of essentially one base, and one slide cover on the base.

U.S. Pat. No. 3,828,802 relates to a device for applying wax to human hair, and features a base with a hinged closure, and a multi-sided cake therein, provided with different wax compositions. The base has a side opening, and the cake is turnable in the base so as to expose any one of its multiple sides toward the opening of the base. Several variations on this theme are also disclosed.

U.S. Pat. No. 4,944,402 relates to a multiple-compartment cosmetic container having a number of interconnected, sectional parts capable of being fitted one upon the other, and wherein the sectional parts each have slots to receive sliding drawers for containing cosmetic substances. Cooperable interlocking structures on the sectional parts enable them to be quickly assembled to one another, or broken down. The arrangement is such that different sectional configurations are made possible, according to the preferences of the user.

U.S. Pat. No. 5,025,817 involves a cylindrical vanity case providing a plurality of individual drawers about the side wall of the case. The drawers can be opened simultaneously by twisting one part of the case with respect to a second. An upper compartment is also provided, with its own closure, and a second, larger closure is hingedly connected to the remainder of the case.

U.S. Pat. No. 7,828,000 discloses a multi-part cosmetic container, having essentially a base and slide cover therefor, with a compartment in the base and a second compartment in a recess in the cover. The second compartment has a flap hinged thereto, to expose a mirror on the underside of the flap.

Published Patent Application No. 2010/0319723 discloses a multi-drawer make-up kit constituted of a plurality of complementary boxes that can be interconnected to one another in order to form a number of different configurations. Complementary male and female structures on different faces of the blocks provide retention to maintain the blocks in assembled relation.

It is considered that large scale commercialization of the devices noted above has not occurred. Undue complexity may have been a concern. Alternately, promotional considerations may have prevented the disclosed arrangements from being made and sold in quantity.

It is further noted that some of the devices discussed above did not relate directly to cosmetic applications. Accordingly, the relatively high demand today, for treatments to the face, hands, and body, has resulted in the need for large-scale, inexpensive yet reliable methods and fixtures for storing and dispensing health-care and/or beauty-care products.

SUMMARY OF THE INVENTION

The above shortcomings of prior cosmetic and like dispensers are largely overcome by the present invention, which is believed to have at least one or more of the following objects:

To provide an improved cosmetic compact which is both simple in construction and reliable in operation.

To provide an improved compact as above, wherein an especially large number of separate cosmetic products and/or cosmetic utensils can be accommodated.

To provide an improved compact of the kind indicated, wherein different products are accessed by selective movement between base and cover members, in any one of four different directions.

The invention provides a cosmetic compact, comprising in combination an expansive base member having a series of upwardly-facing product wells to accommodate one or more cosmetic substances or cosmetic articles, respectively, a cover member, and an expansive shuttle piece interposed between the base member and cover member, said shuttle piece and base member having cooperable slide bearing means for enabling the shuttle piece to slide in opposite directions with respect to the base member, said shuttle piece and cover member having additional cooperable slide bearing means for enabling the cover member to slide in opposite directions with respect to the shuttle piece and base member, said first cooperable slide bearing means and said additional cooperable slide bearing means being substantially orthogonal with respect to one another, whereby the cover member can undergo universal sliding movement with respect to the base member.

Other features and advantages will hereinafter appear.

BRIEF DESCRIPTION OF THE DRAWINGS

In the drawings, illustrating several embodiments of the invention.

DESCRIPTION OF THE PREFERRED EMBODIMENTS

Figure 1:
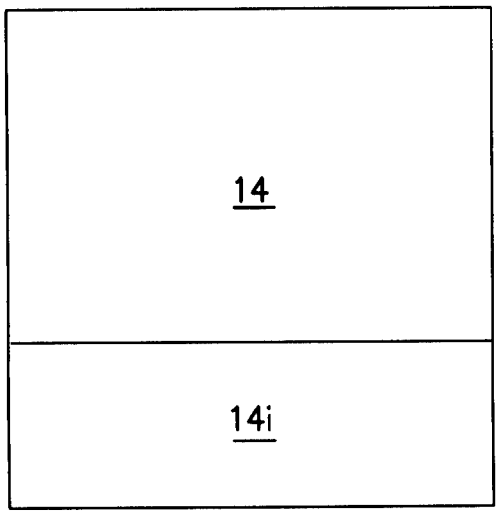
FIG. 1 is a top plan view of the improved cosmetic compact of the invention.
Figure 2:
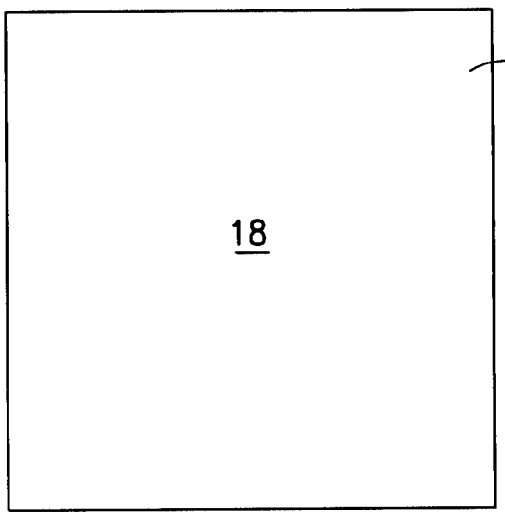
FIG. 2 is a bottom plan view of the compact of FIG. 1.
Figure 5:
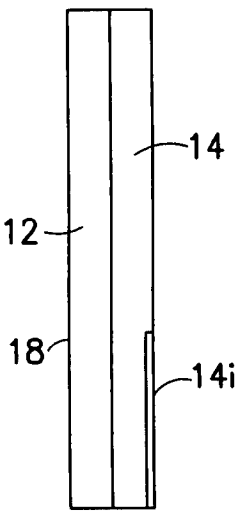
FIG. 5 is a right side elevation, of the compact of FIGS. 1-4, the corresponding left side view being a mirror image of the right side view.
Figure 3:
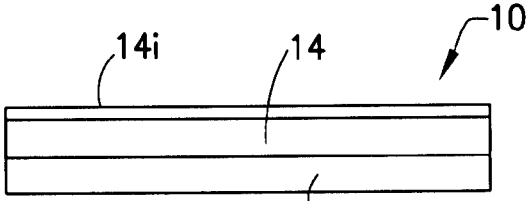
FIG. 3 is a front elevation of the compact of FIGS. 1 and 2.
Figure 4:
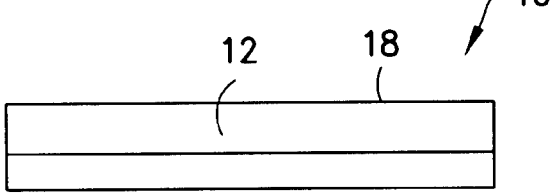
FIG. 4 is a rear elevation, inverted, of the compact of FIGS. 1-3.

Referring first to FIGS. 1-10, there is illustrated a cosmetic compact 10 for storing a plurality of cosmetic materials and/or mirrors and/or cosmetic utensils of a type generally utilized by a consumer and adapted to be carried in a pocketbook or handbag.

In accordance with the present invention the cosmetic compact 10 includes a molded plastic outer casing comprising a base member designated by the numeral 12, a cover member 14 and an intermediary member or shuttle piece 16 interposed therebetween. The shuttle piece 16 and base and cover members 12, 14 have complementary molded structures which in a unique manner, permit the cover member 14 to remain captive on the base member 12 while at the same time permitting its controlled, universal movement with respect thereto.

Referring to specific details of the construction, reference will be made to FIGS. 11 and 12, which are exploded views of the compact, showing its specific structural components. The base member 12 has an expansive bottom wall 18 that features a plurality of molded, upwardly facing peripheral compartments 20 that are arranged to store cosmetic powders, mirrors, or utensils in a manner such that they are normally concealed from view during storage of the compact, and which are capable of being selectively exposed by a unique sliding movement of the cover member in any of four different directions on the base member. The four distinct open positions of the compact are shown particularly in FIGS. 7-10, respectively.

Figure 13:
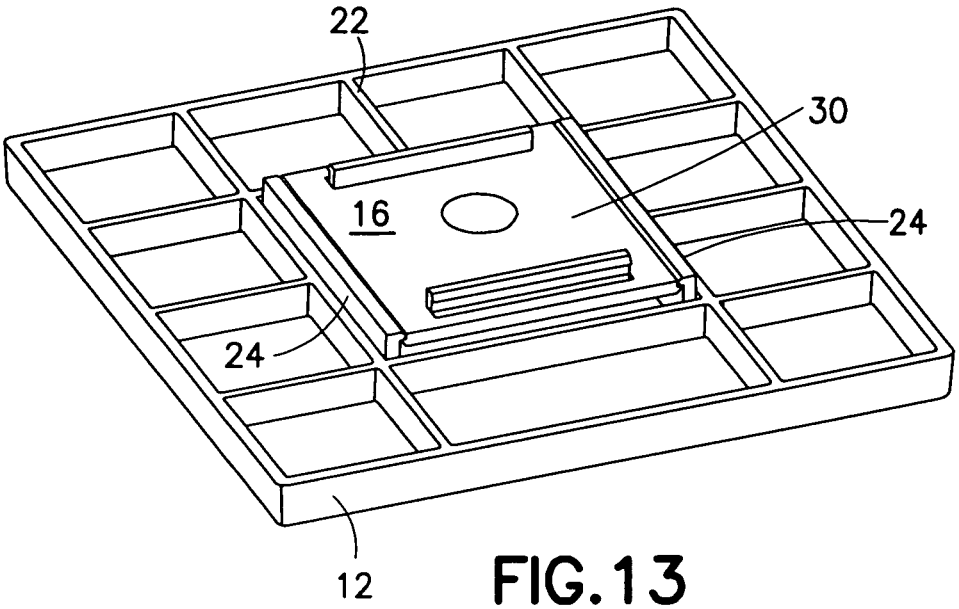
FIG. 13 is a perspective view of the base member and shuttle piece of the compact of FIGS. 1-12, with the shuttle piece in a central or "home" position on the base member.
Figure 14:
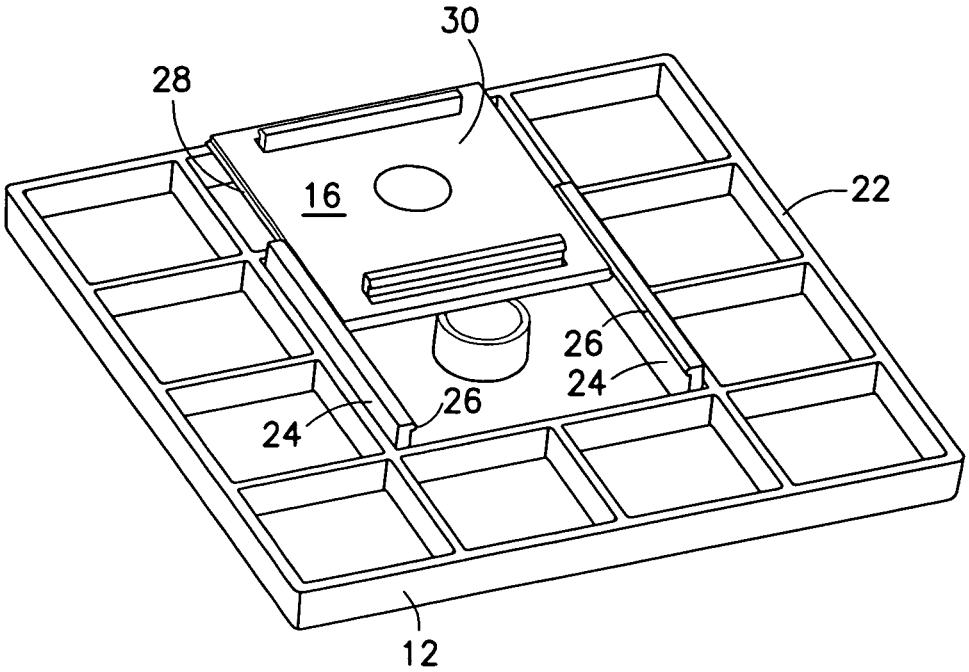
FIG. 14 is a perspective view of the base member and shuttle piece of the compact of FIGS. 1-13, except with the shuttle piece in one of two possible open positions on the base member.
Figure 15:
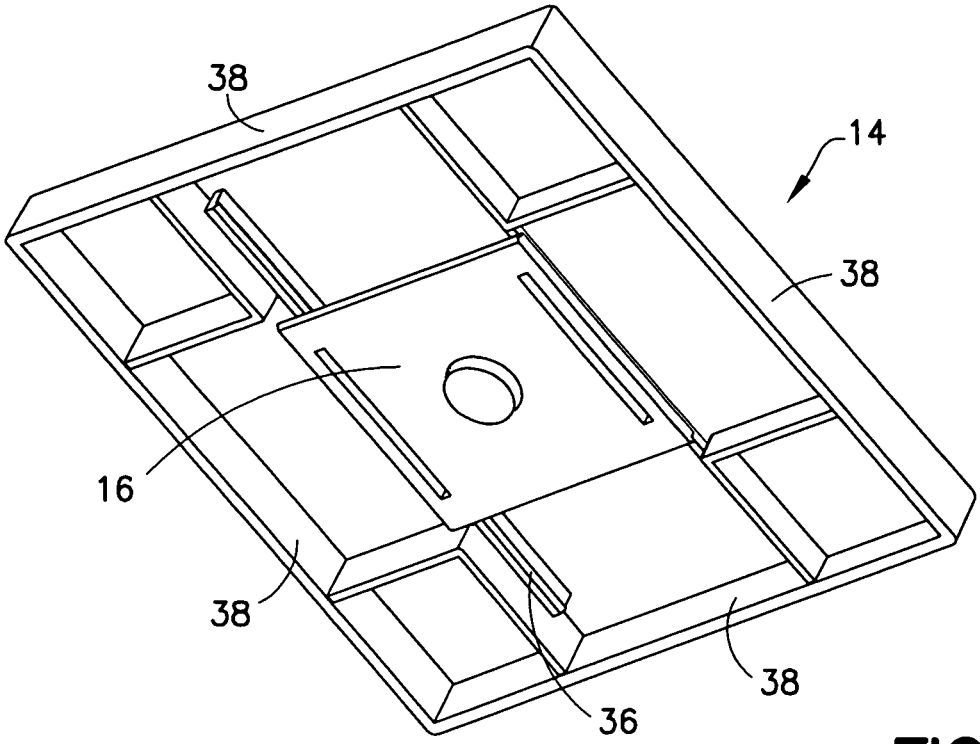
FIG. 15 is a perspective view of the underside of the cover member and shuttle piece of the compact of FIGS. 1-14, with the shuttle piece in a central or "home" position on the cover member.
Figure 16:
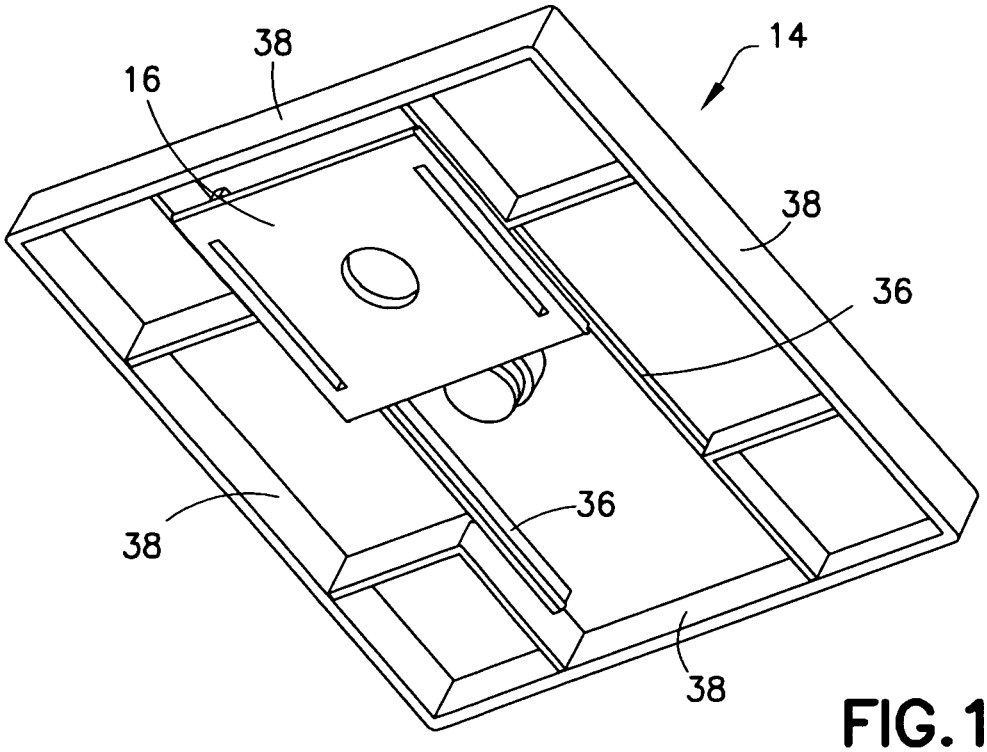
FIG. 16 is a perspective view like FIG. 15, except with the shuttle piece in one of two possible open positions on the cover member.
Figure 17:
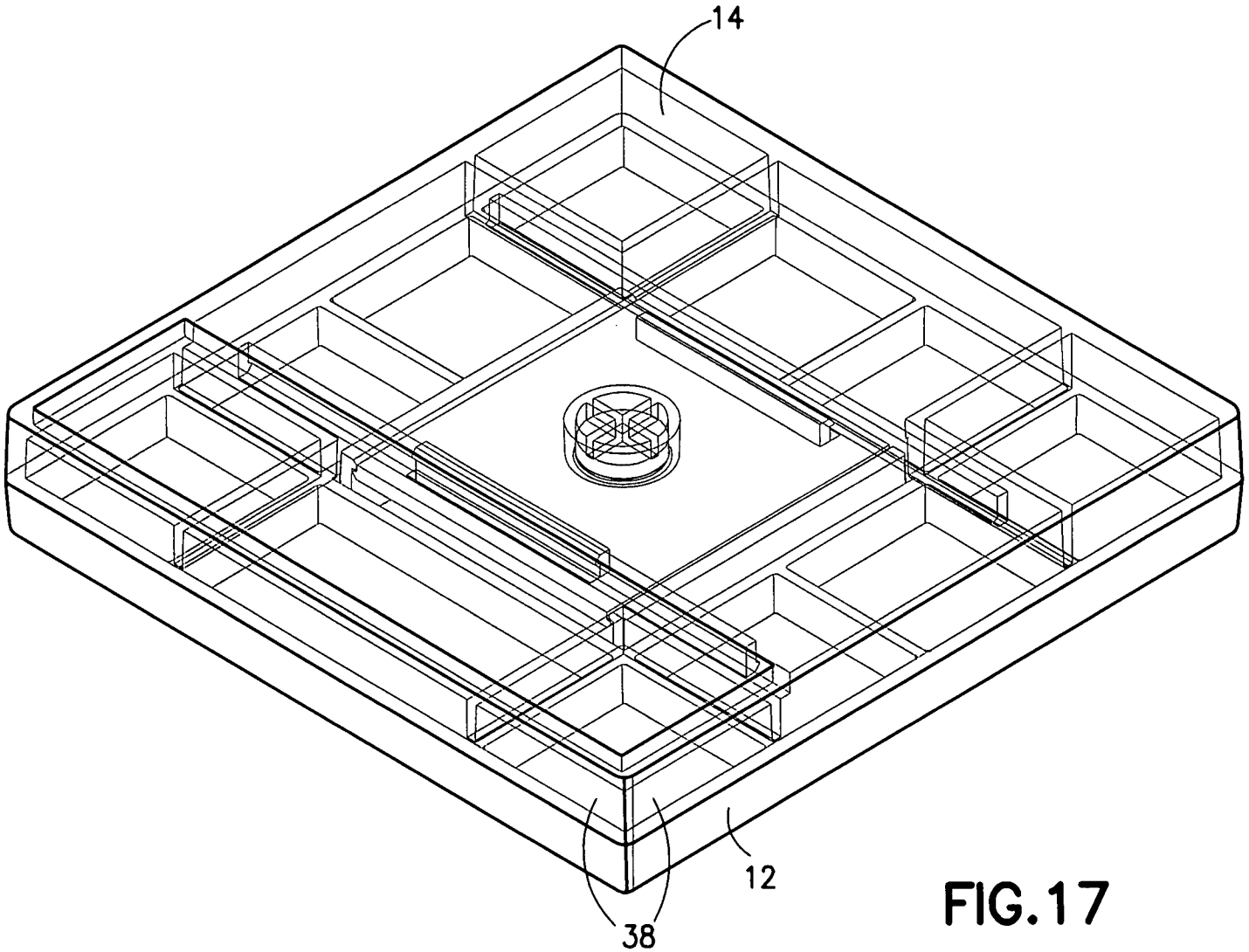
FIG. 17 is a perspective, pictorial representation of the compact of FIGS. 1-16, showing the cover member semi-transparent, and illustrating internal details of the compact when it is disposed in the closed position of FIGS. 1-6.
Figure 18:
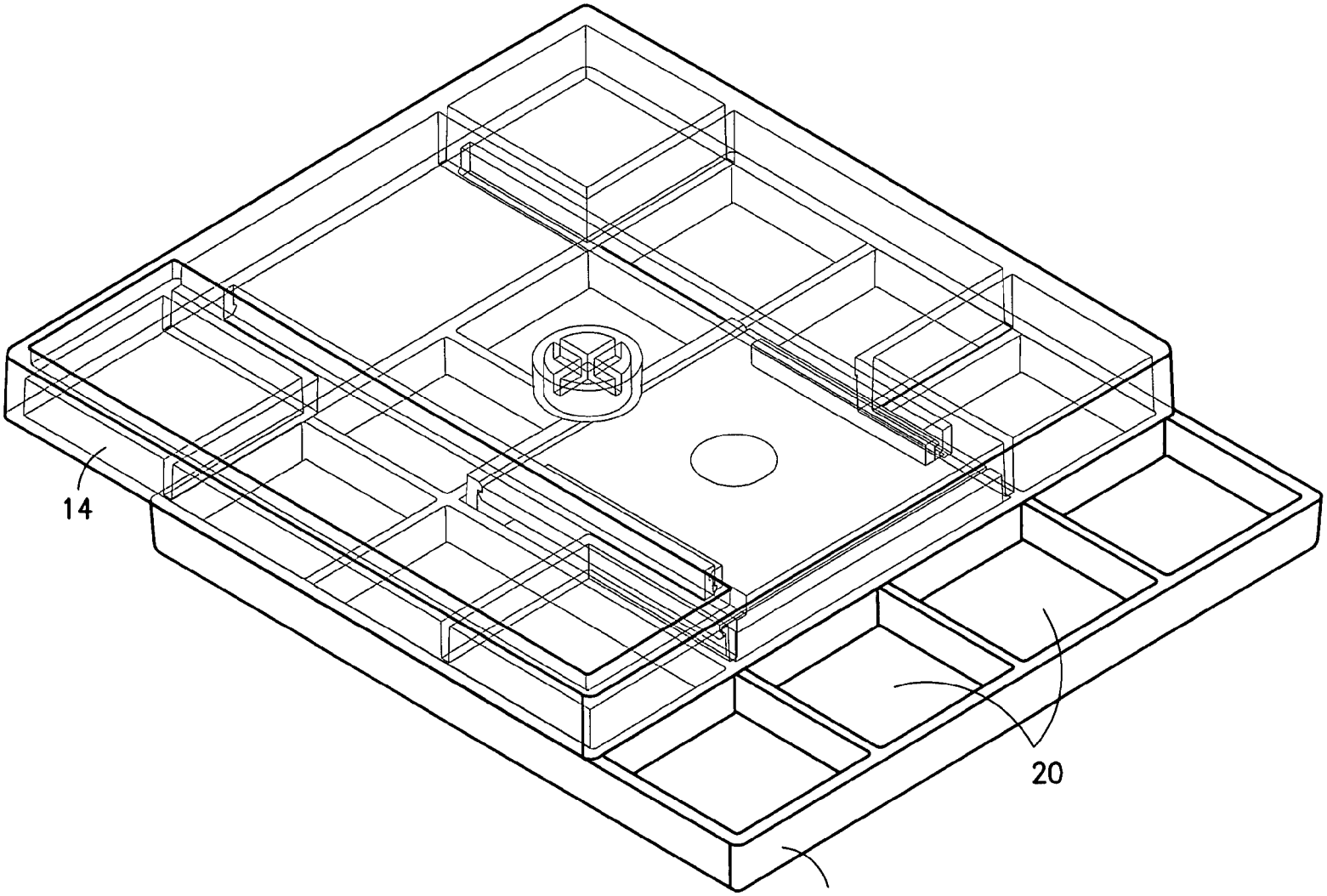
FIG. 18 is a perspective view like FIG. 17, except illustrating internal details of the compact when it is disposed in one of four selectable open positions.
Figure 19:
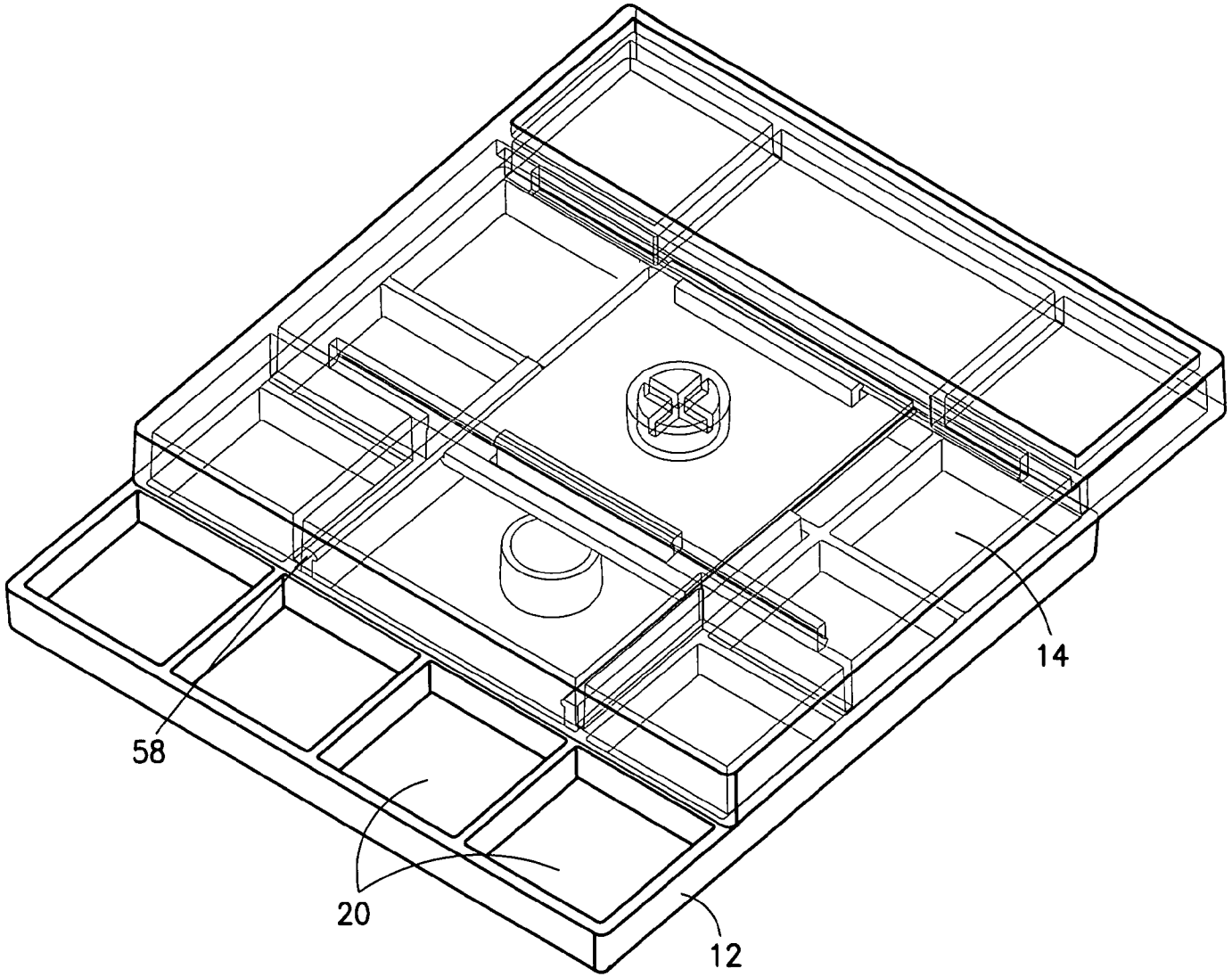
FIG. 19 is a perspective view like FIG. 18, except illustrating internal details of the compact when it is disposed in another of four selectable open positions.
Figure 20:
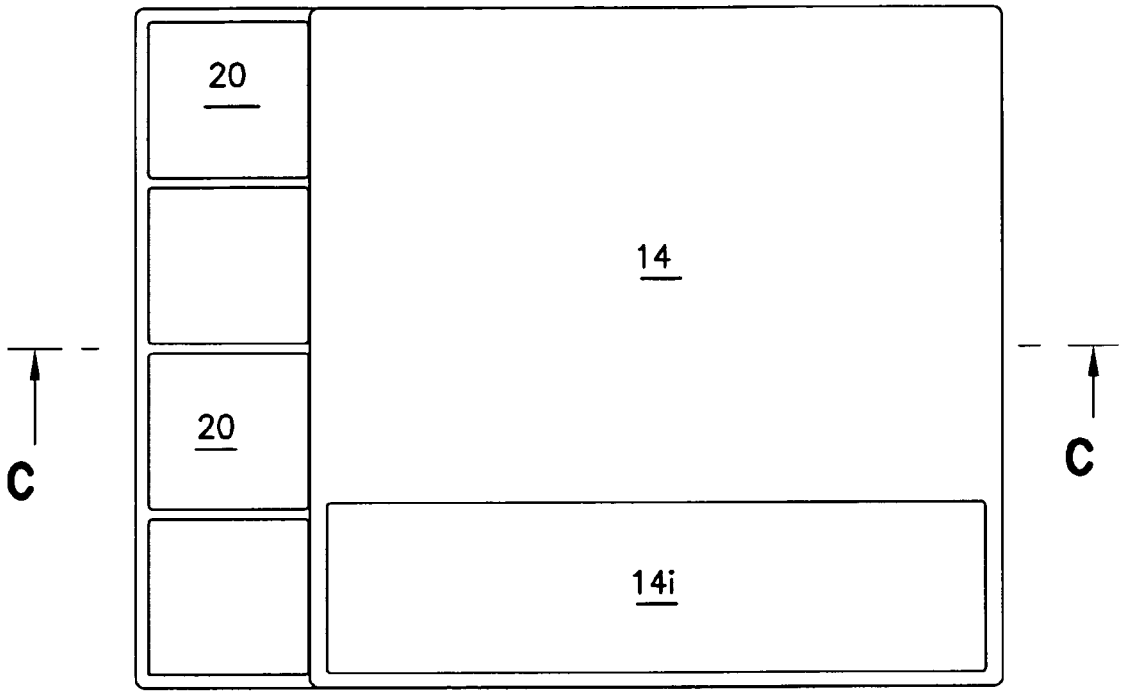
FIG. 20 is a top plan view of the compact of FIGS. 1-19, illustrating the compact when it is disposed in one of four selectable open positions.
Figure 21:
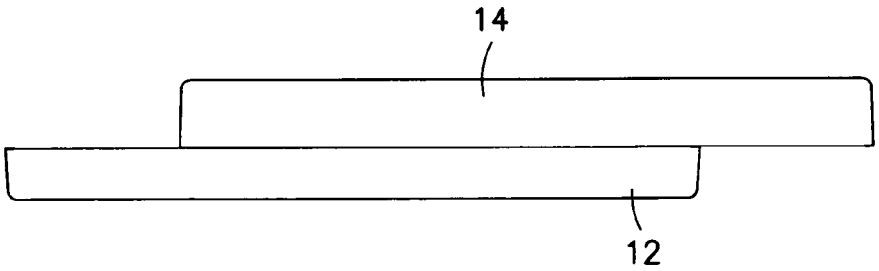
FIG. 21 is a front elevation of the compact of FIG. 20.
Figure 22:
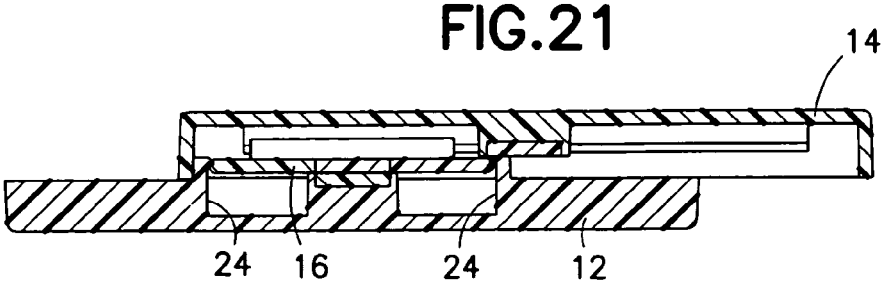
FIG. 22 is a vertical section taken on line C-C of FIG. 20.
Figure 25:
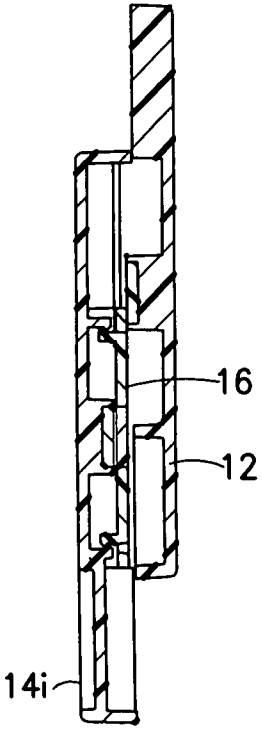
FIG. 25 is a section taken on the line D-D of FIG. 23.
Figure 24:
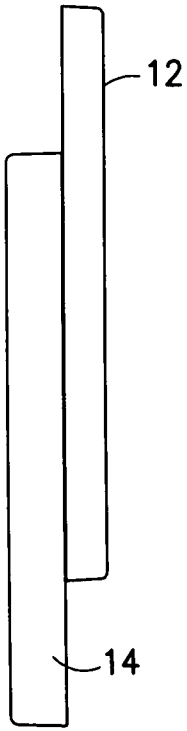
FIG. 24 is a right side elevation of the compact of FIGS. 1-23.
Figure 23:
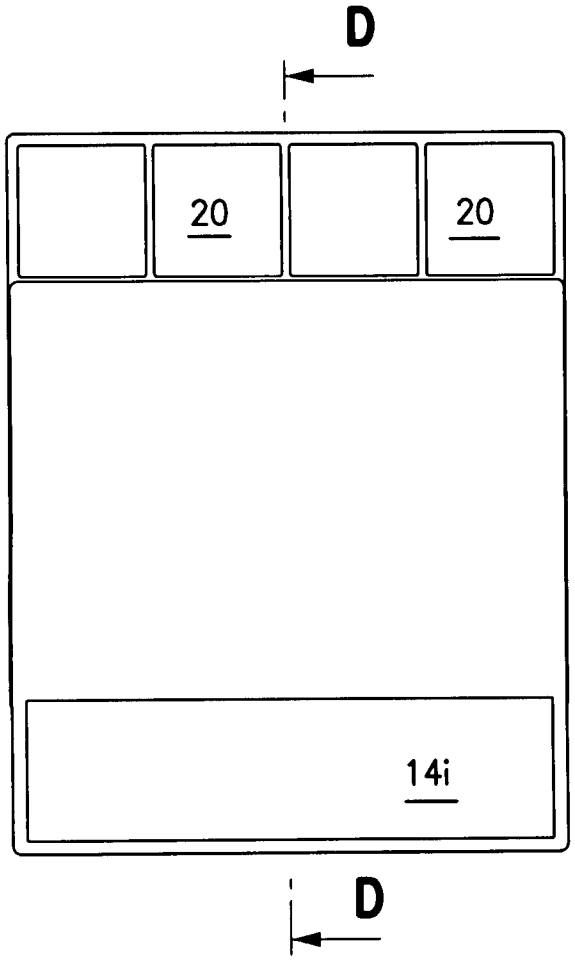
FIG. 23 is a top plan view of the compact of FIGS. 1-22, illustrating the compact when it is disposed in a second one of four selectable open positions, different from the position of FIG. 20.
Figure 26:
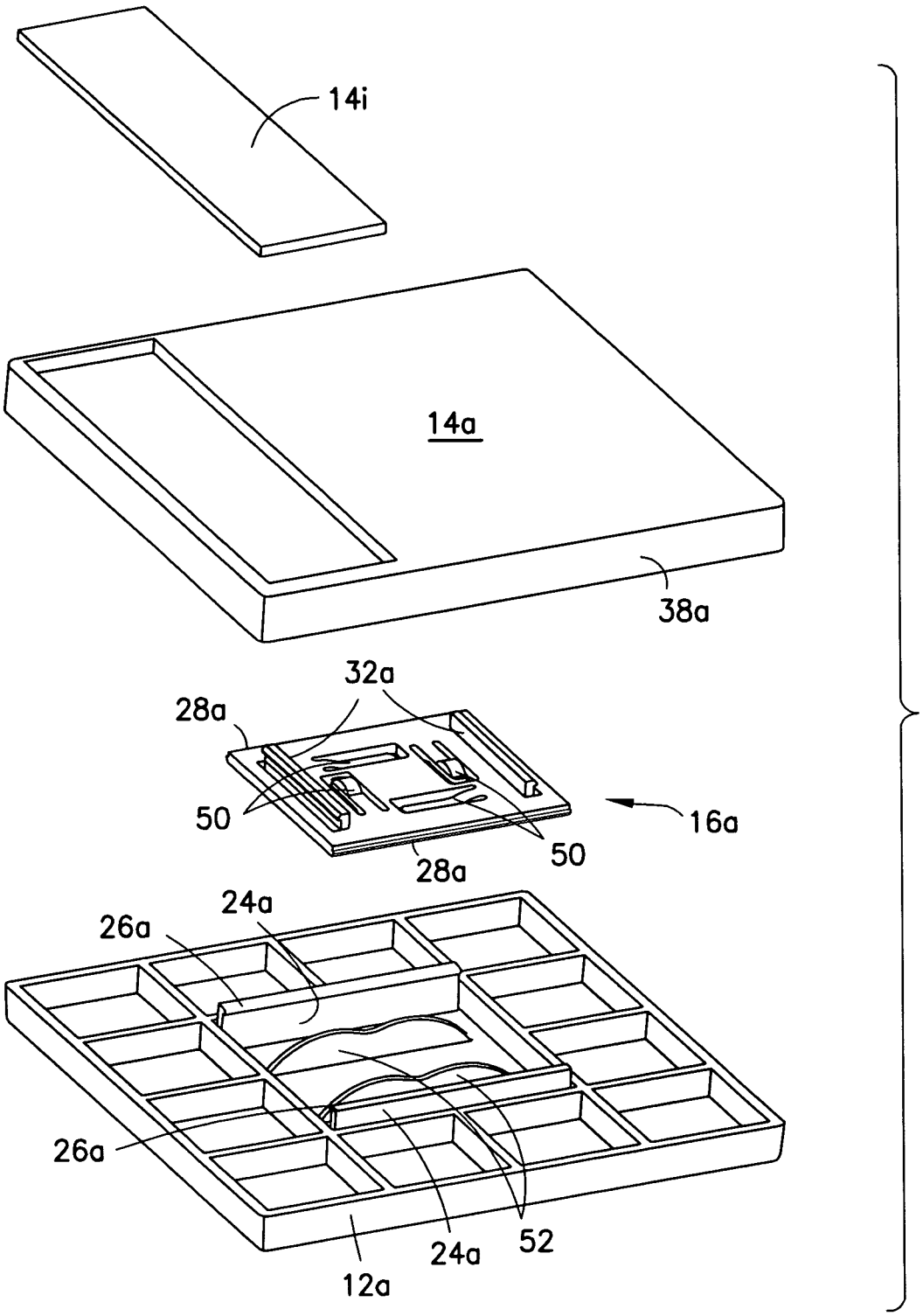
FIG. 26 is an exploded view of a modified cosmetic compact, constituting another embodiment of the invention.
Figure 27:
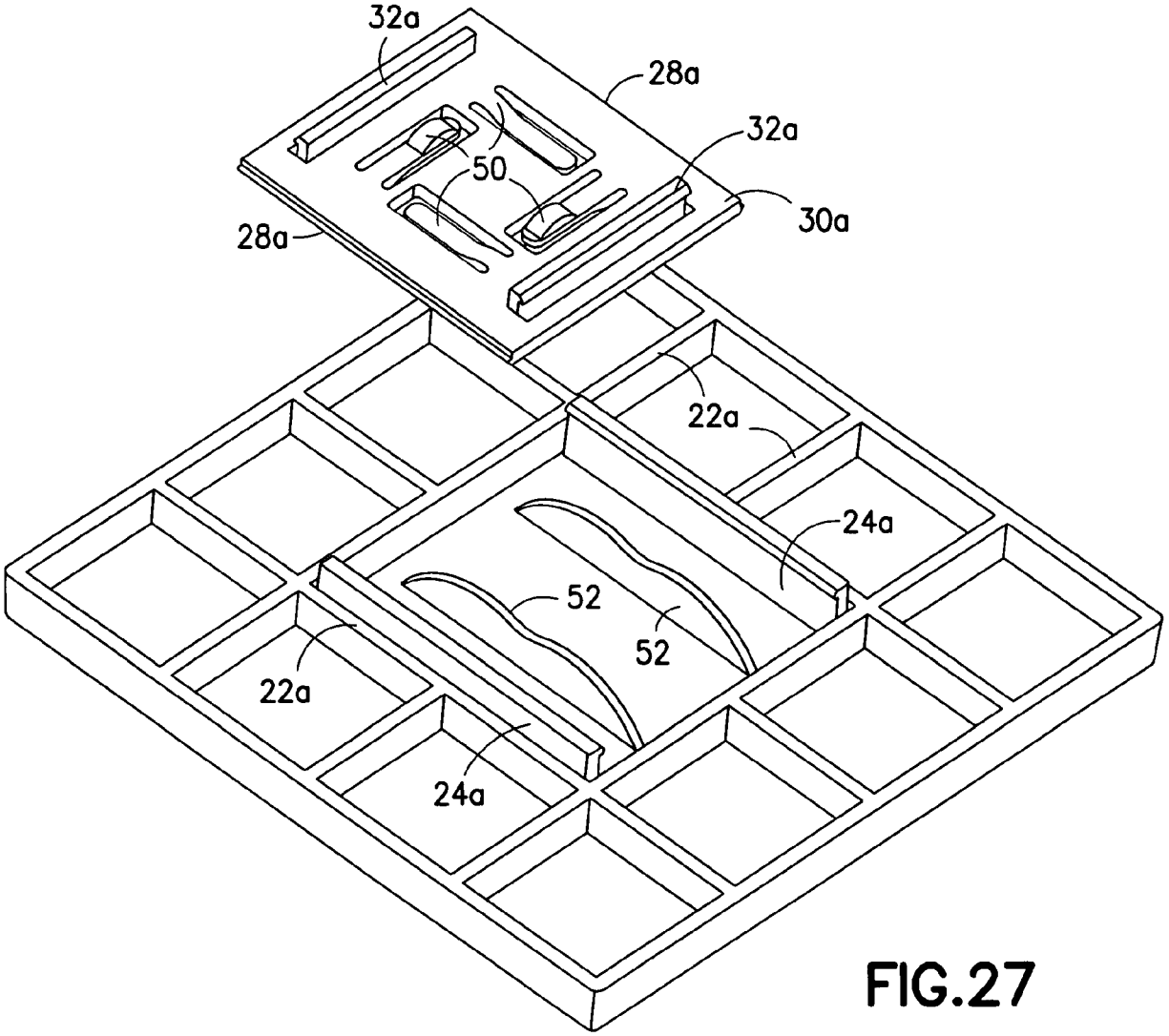
FIG. 27 is an exploded view of the compact of FIG. 26, viewed from above its base member and shuttle piece.
Figure 28:
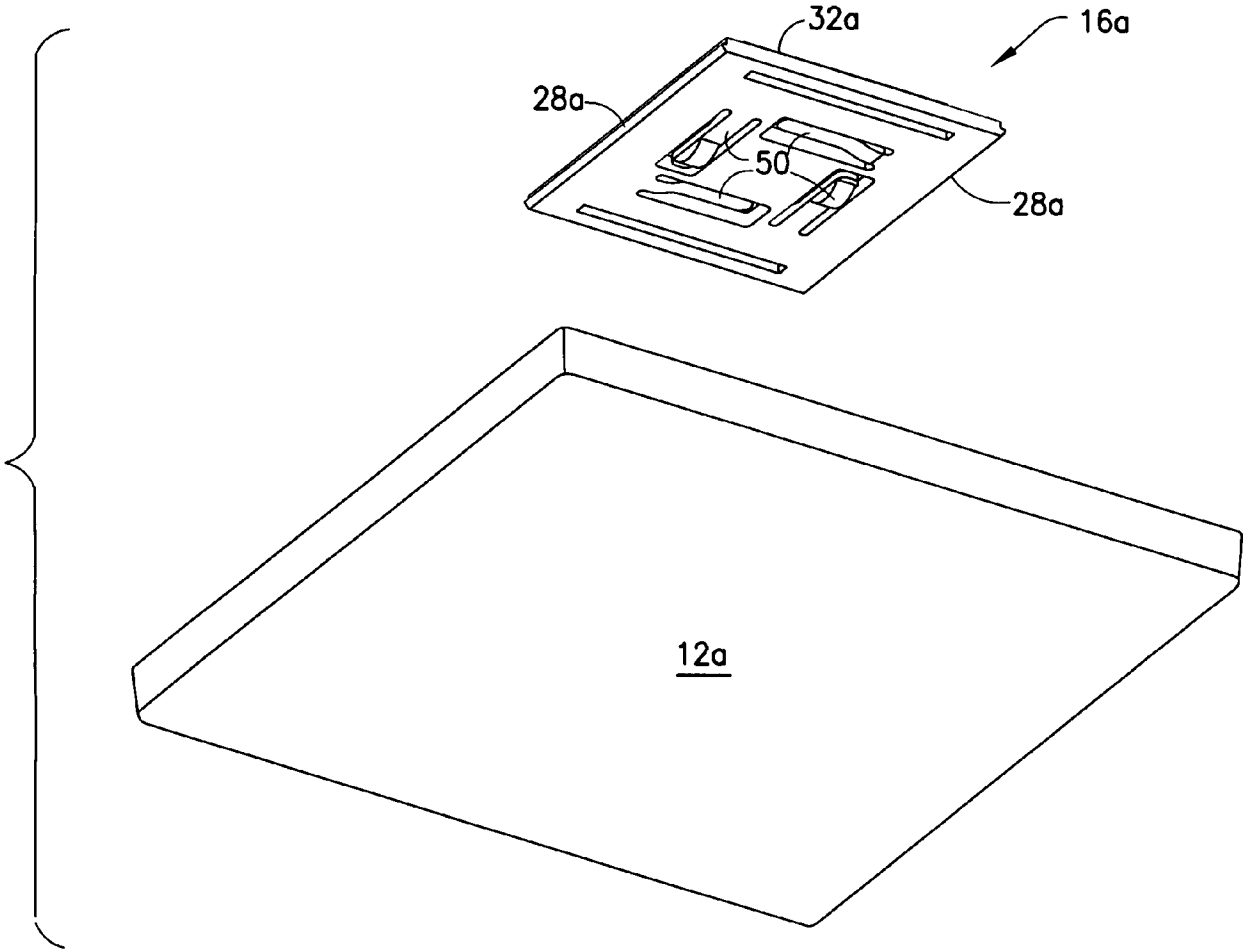
FIG. 28 is an exploded view of the underside of the base member and shuttle piece, of the compact of FIGS. 26-27.
Figure 29:
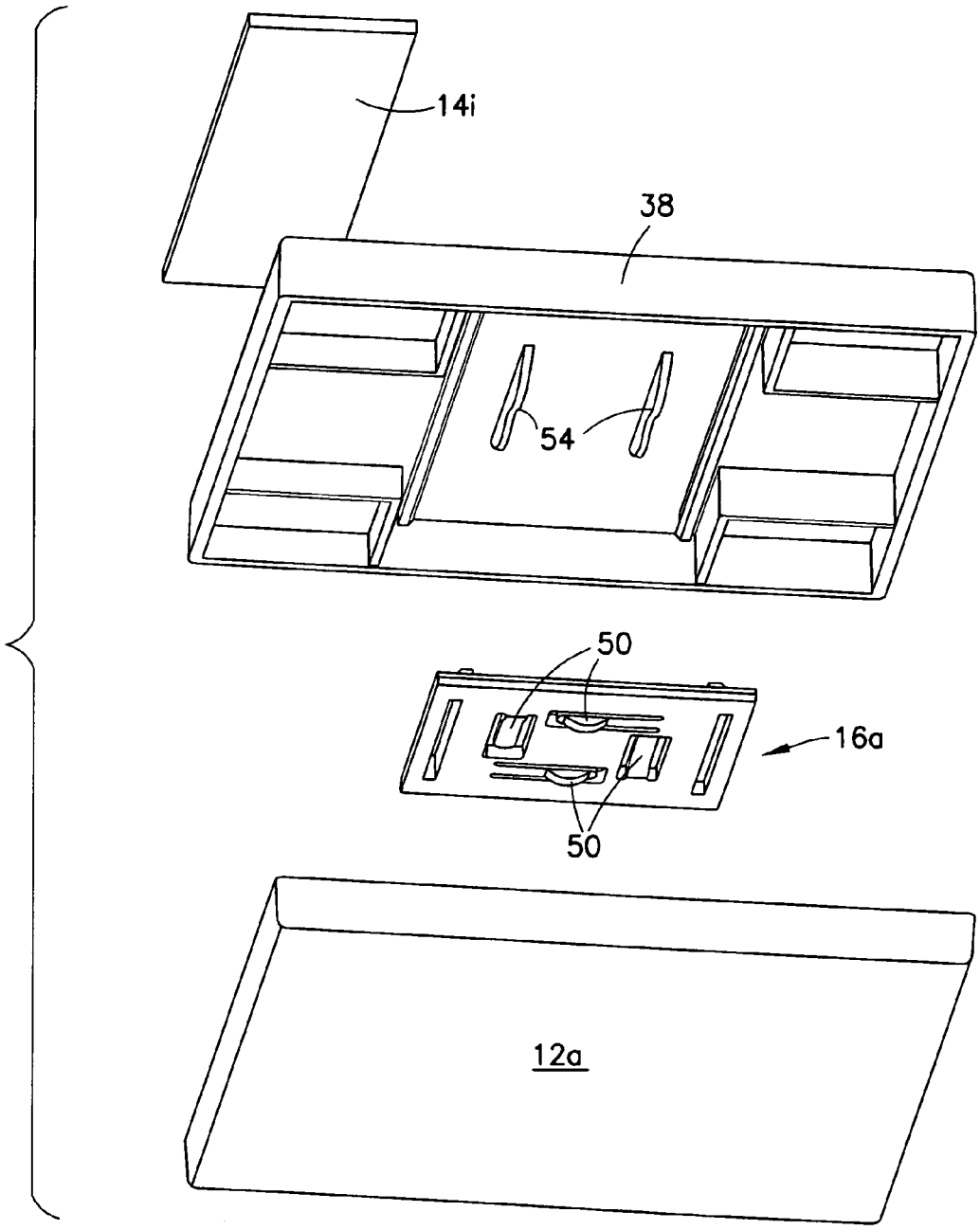
FIG. 29 is an exploded view of the underside of the base member, shuttle piece and cover member of the compact of FIGS. 26-28.
Figure 32:
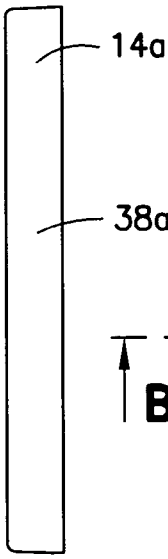
FIG. 32 is a left end elevation of the cover member of FIGS. 26-31.
Figure 30:
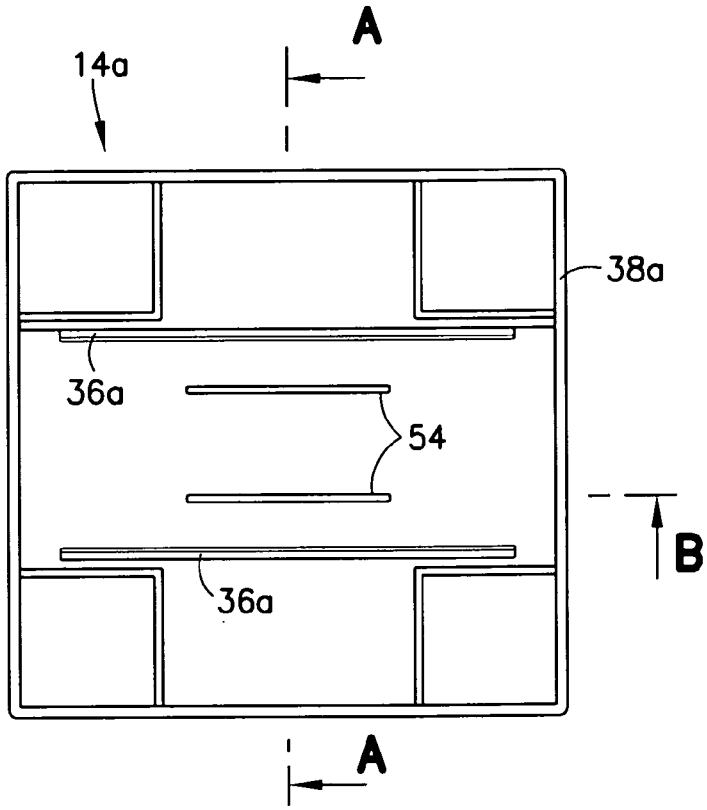
FIG. 30 is a plan view of the underside of the cover member in the compact of FIGS. 26-29.
Figure 33:
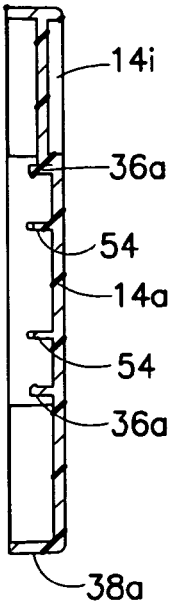
FIG. 33 is a vertical section taken on the line A-A of FIG. 30.
Figure 31:
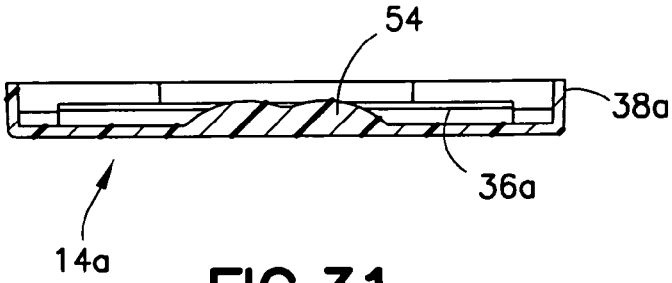
FIG. 31 is a vertical section taken on the line B-B of FIG. 30.
Figures 34, 37, 38:
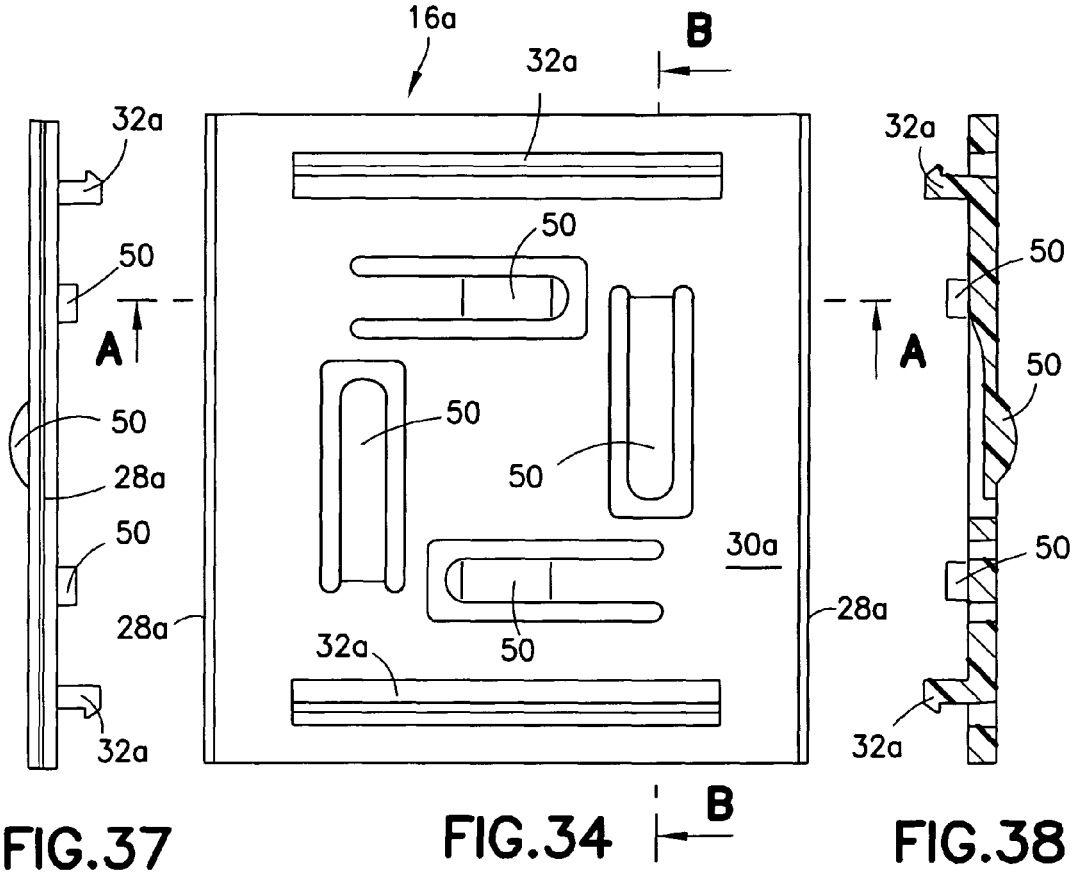
FIG. 34 is a top plan view of the shuttle piece utilized in the compact of FIGS. 26-33.
FIG. 37 is a left end elevation of the shuttle piece utilized in the compact of FIGS. 26-36.
FIG. 38 is a transverse section taken on the line B-B of FIG. 34.
Figure 35:
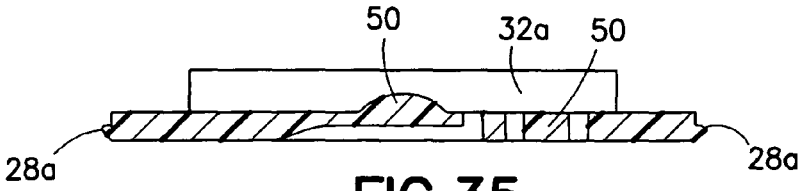
FIG. 35 is a transverse section taken on the line A-A of FIG. 34.
Figure 36:
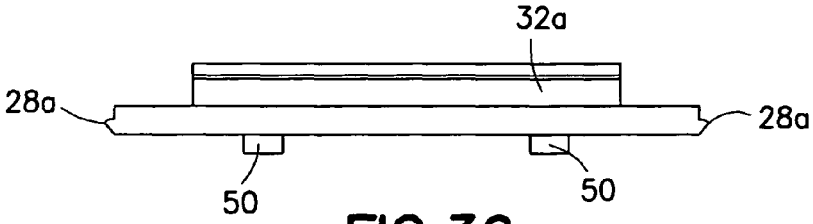
FIG. 36 is a front elevation of the shuttle piece utilized in the compact of FIGS. 26-35.
Figure 42:
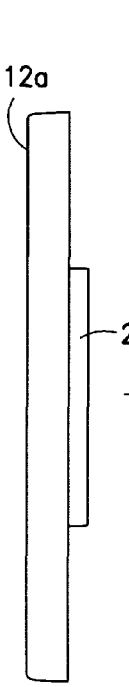
FIG. 42 is a left side elevation of the base member as utilized in the compact of FIGS. 27-41.
Figure 39:
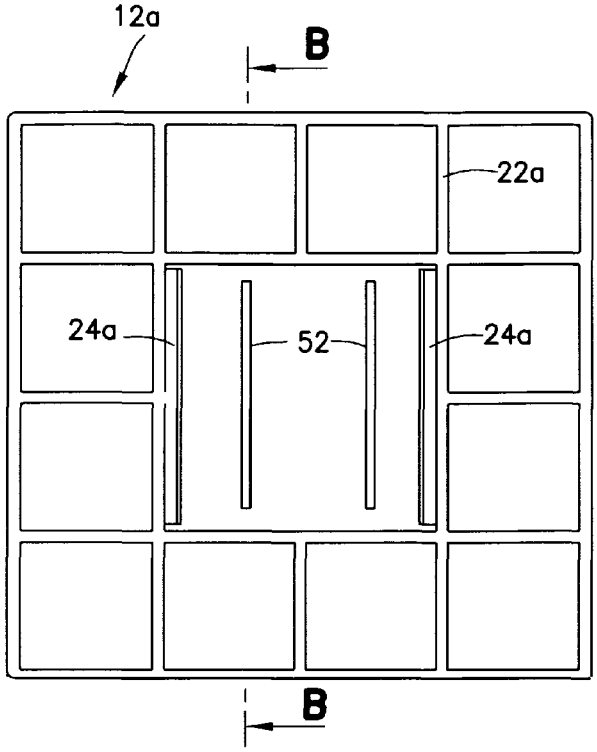
FIG. 39 is a top plan view of the base member utilized in the compact of FIGS. 27-38.
Figure 43:
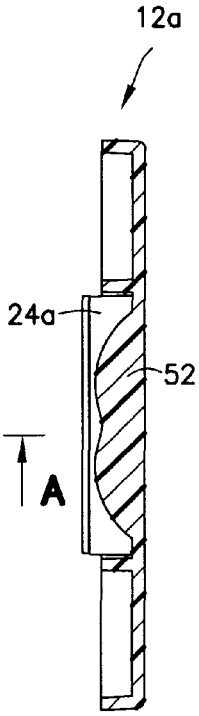
FIG. 43 is a transverse section taken on the line B-B of FIG. 39.
Figure 40:
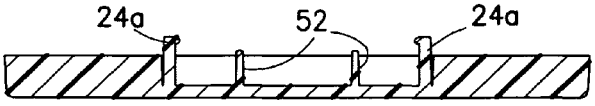
FIG. 40 is transverse section taken on the line A-A of FIG. 39.
Figure 41:
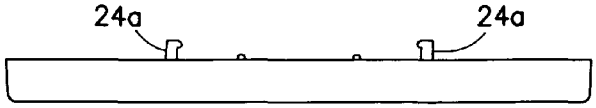
FIG. 41 is a front elevation of the base member as utilized in the compact of FIGS. 27-40.
Figure 44:
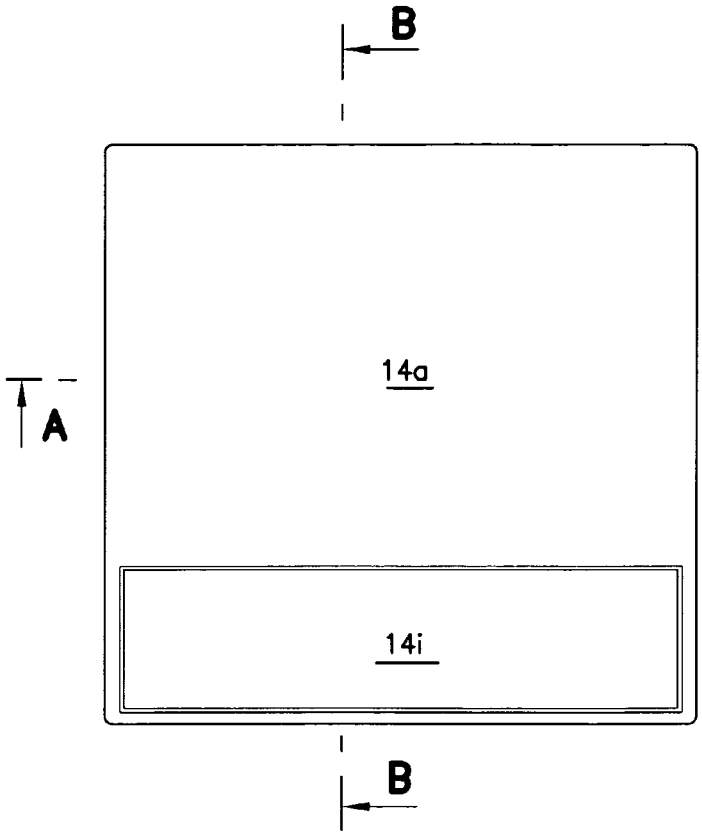
FIG. 44 is a top plan view of the modified compact of FIGS. 27-43.
Figure 46:
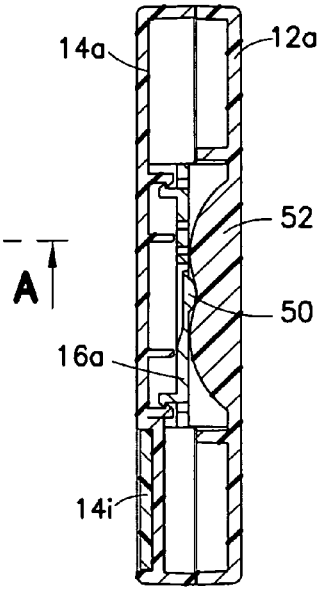
FIG. 46 is a transverse section taken on the line B-B of FIG. 44.
Figure 45:
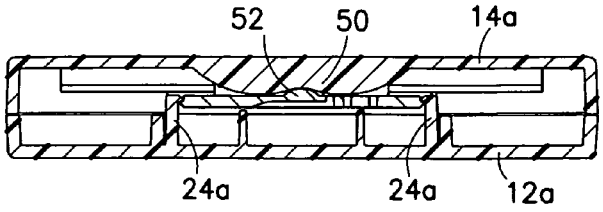
FIG. 45 is a transverse section taken on the line A-A of FIG. 44.
Figure 47:
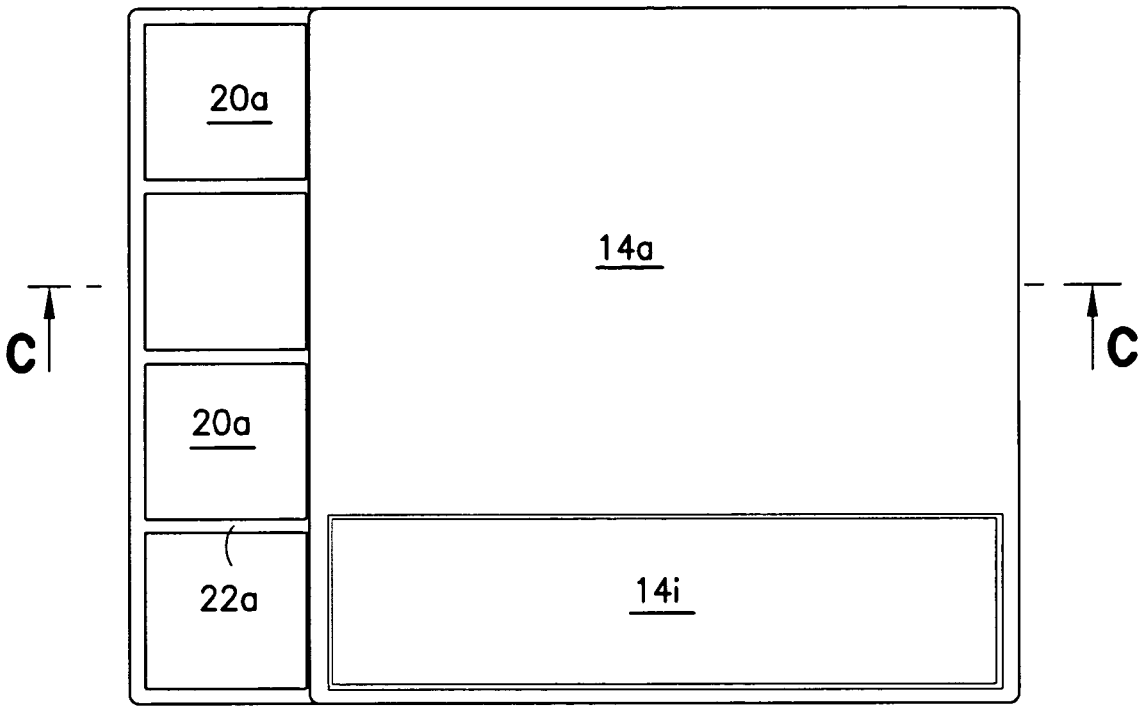
FIG. 47 is a top plan view of the compact of FIGS. 27-47, illustrating the compact when it is disposed in one of four selectable open positions.
Figure 48:
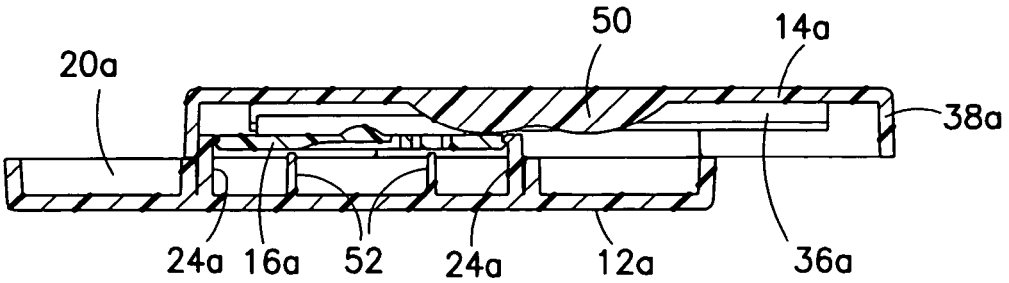
FIG. 48 is a transverse section taken on the line C-C of FIG. 47.
Figure 49:
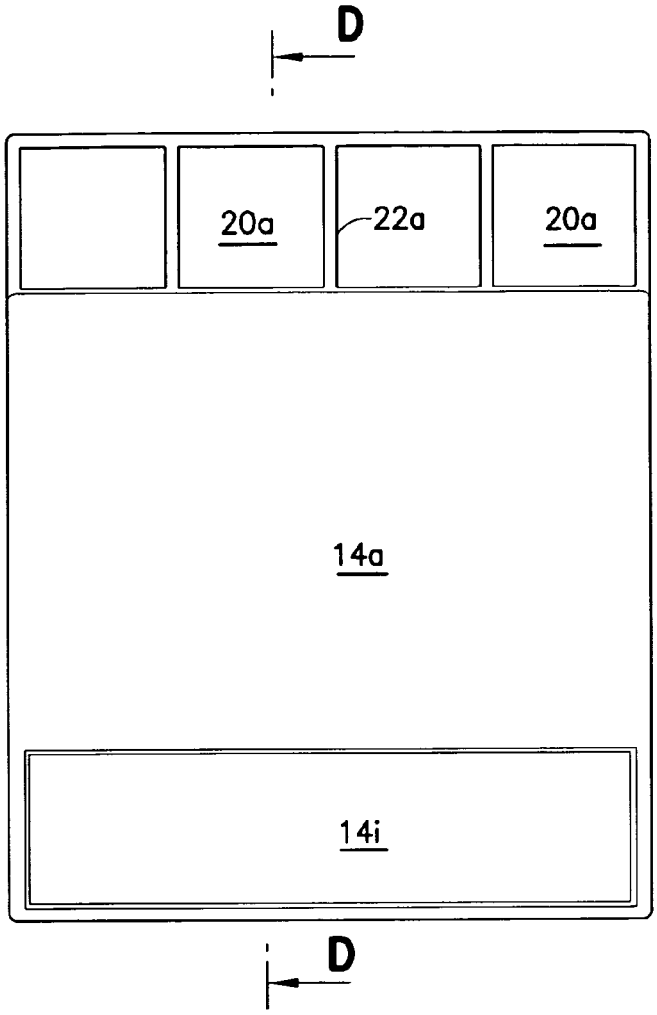
FIG. 49 is a top plan view of the compact of FIGS. 27-48, illustrating the compact when it is disposed in another one of four selectable open positions.
Figure 50:
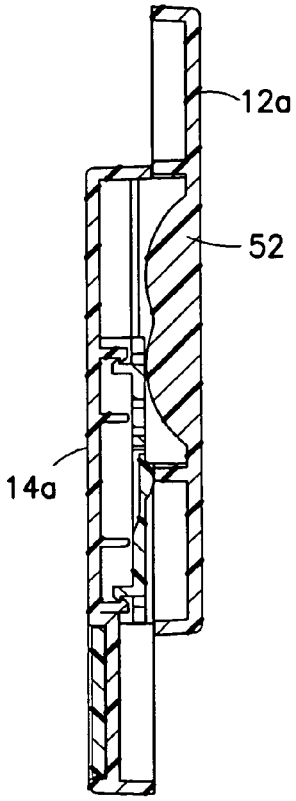
FIG. 50 is a transverse section taken on the line D-D of FIG. 49.

The upper surfaces of the base member 12 are preferably all in a single plane such that unobstructed sliding movement of the cover member 14 is made possible on this plane. The network of the connections between the various peripheral compartments forms a substantially rectangular lattice 22 when the base member 12 is viewed by itself, from above. Various portions of this lattice 22 are shown in FIGS. 13 and 14.

Further by the invention, relative sliding movement between the cover member 14, the shuttle piece 16 and the base member 12 is rendered possible in part, by a pair of upstanding, coextensive rails 24 on the base member 12, which in turn are provided with facing, inwardly directed beads 26 along the their full lengths. The upper portions of the rails which contain the beads 26 extend above the plane of the lattice 22 noted above, for engagement by cooperable edge structures on the shuttle piece 16, as will become apparent below.

Two opposite edge portions 28 of the shuttle piece 16 are preferably provided with grooves or other similar formations that will operate to hold the shuttle piece captive while enabling it to slide within limits, with respect to the base member 12.

Referring again to FIGS. 11 and 12, the shuttle piece 16 is provided on its upper face 30 with a pair of spaced apart rails 32, whose upper edges are in each case, provided with outwardly facing beads 34. In these figures it can be seen that the beads cooperate with and engage additional parallel rails 36 that depend from the undersurface of the cover member 14. Since FIG. 12 is inverted, the rails 36 are shown as upwardly extending in the figure. With the disclosed arrangement, the rails 36 on the cover member 14 slidably engage the rails 32 on the shuttle piece 16 and as a result, the cover member 14 can move between limits, with respect to the shuttle piece 16.

The cover member 12 is provided with an insert panel 12*i* which can be utilized to individualize the cosmetic unit hereinafter described.

In accordance with the invention, the movement between the shuttle piece 16 and cover member 14 is in a direction that is orthogonal to the direction of sliding movement between the shuttle piece 16 and base member 12. The arrangement is such that the cover member 14 can have universal sliding movement in four directions with respect to the base member, which gives rise to the various possible displacement examples illustrated in FIGS. 7-10.

Another feature of the arrangement just described resides in the stop function that is provided by the base member 12 and against the cover member 14. In accomplishing such a stop function which needs to be operative for any one of the four open-cover member arrangements, the cover member 14 is provided with four depending outer flanges 38 which, together with its expansive top wall 40, form its outermost surfaces.

Figure 11:
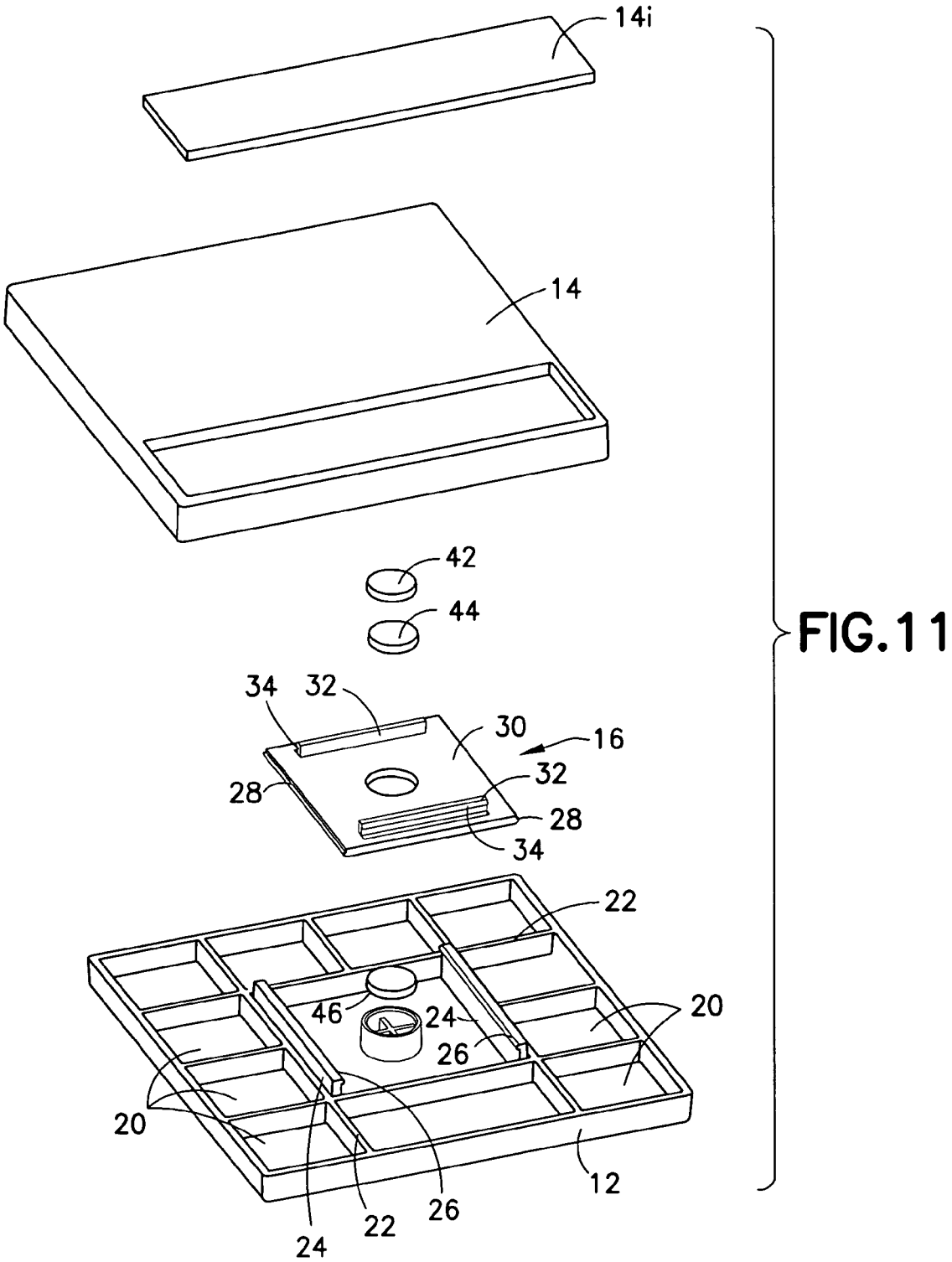
FIG. 11 is an exploded view of the compact of FIGS. 1-10.
Figure 12:
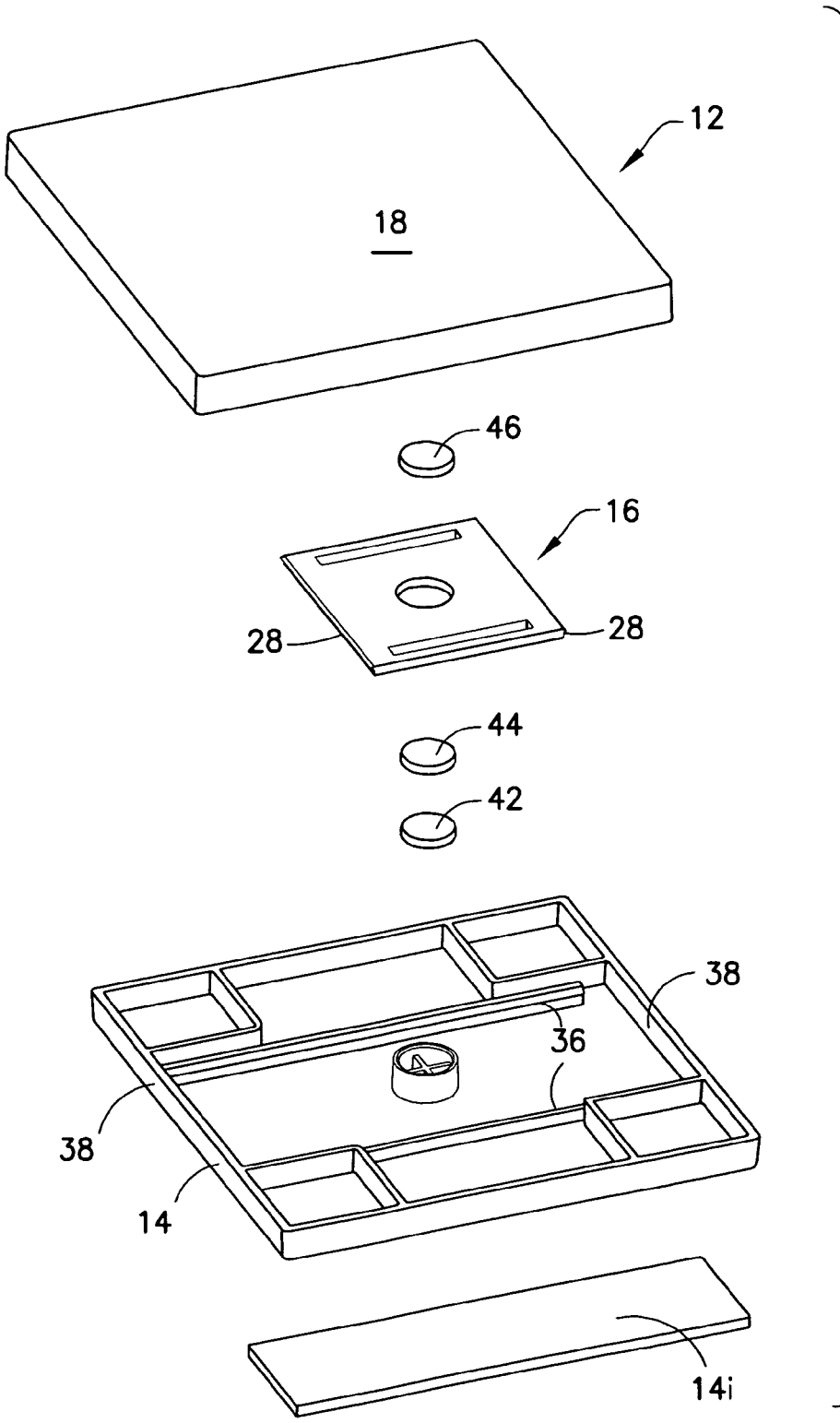
FIG. 12 is an exploded view, inverted, of the compact of FIGS. 1-11.

FIG. 12 shows the depending peripheral flange wall 38 (one of four) which slides in one direction until the flange strikes the two ends of the two base rails 24, respectively, FIG. 11, and which can slide in an opposite direction until the flange strikes the opposite ends of the base rails 24.

The remaining two of the depending flanges 38 of the cover member 14 will engage, broadside, one of the rails 24 in one direction, and the other rail 24 in the opposite direction. Again, four possibilities of the 4 way movement of the cover member 14 with respect to the base member 12 are shown in FIGS. 7-10.

Figure 6:
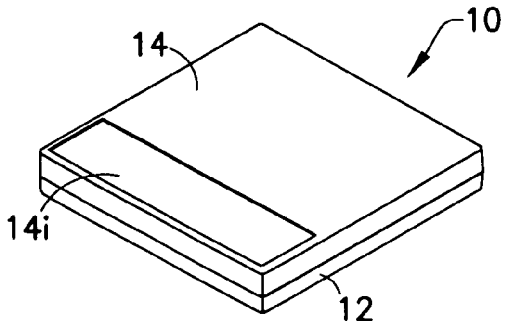
FIG. 6 is a perspective, pictorial representation of the compact of FIGS. 1-5 with the compact shown in the closed position.
Figure 7:
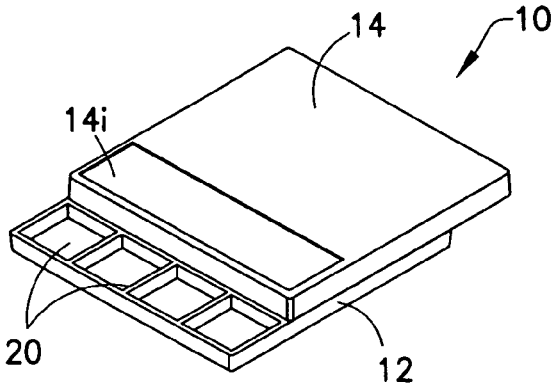
FIG. 7 is a perspective view like FIG. 6, except showing the compact of FIGS. 1-6 in one of four selectable open positions.
Figure 8:
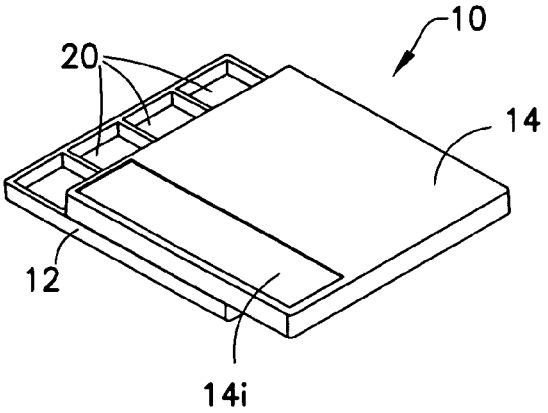
FIG. 8 is a perspective view like FIG. 6, except showing the compact of FIGS. 1-7 in a second one of four selectable open positions.
Figure 9:
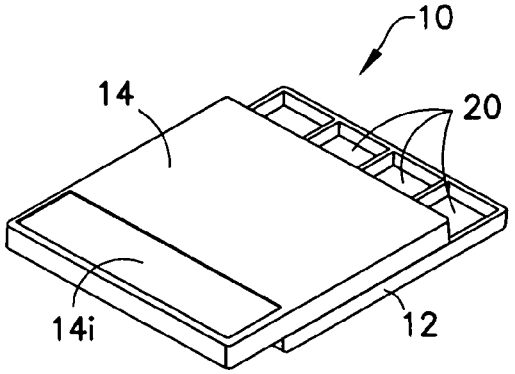
FIG. 9 is a perspective view like FIG. 6, except showing the compact of FIGS. 1-8 in a third one of four selectable open positions.
Figure 10:
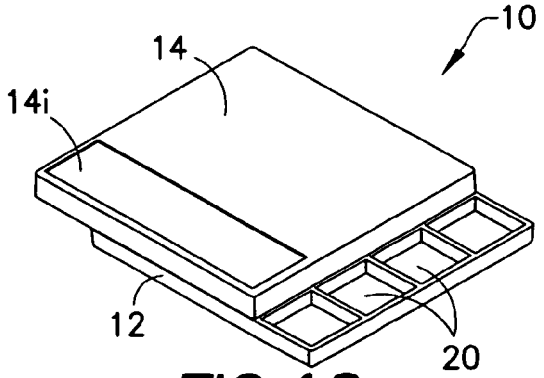
FIG. 10 is a perspective view like FIG. 6, except showing the compact of FIGS. 1-9 in a fourth one of four selectable open positions.

The invention further provides for a biasing force to be exerted on the cover member 14 with respect to the base member 12, tending to draw the cover member 14 toward its closed or centered position, FIG. 6. In accomplishing the centering function, there are provided three magnets 42, 44, 46, which are fitted in suitable openings on the base member 12, shuttle piece 16, and cover member 14, respectively. In an alternate arrangement, one magnet 44 can be utilized in the shuttle piece 16, with ferro magnetic stock for installation in the cover member and base member. Securement of all the magnetic components can be by means of suitable cement or adhesive.

Another embodiment of the invention is shown in FIGS. 26-50. Components on the embodiment corresponding to those of the first are designated by similar reference numerals except by inclusion of the suffix "a". The details previously explained function to permit the 4 way sliding movement of the cover member 14 on the base member 12.

In place of the magnetic centering arrangement represented by the components 42, 44 and 46, by the present invention there is provided a modified construction for providing to the user, variable resistance against sliding movement, such resistance being dependent on the relative location of the cover member with respect to the base member shown in FIGS. 26-29. Four spring fingers 50 are molded into the shuttle piece 16*a*, and disposed in locations thereon so as to engage cooperable contoured upwardly-extending elevator blades 52 on the base member 12*a*, and cooperable depending elevator blades 54 on the underside of the cover member 14*a*. The elevator blades 52 are both of the same configuration, and each is of arcuate outline or profile, with a dip at the midpoint of the respective blade and a separate, decreasing slope on each end as the distance from the center dip increases, until the blade merges completely into the surrounding plane surface.

In operation, the engagement of two spring fingers 50 with the blades 52 on the base member 12*a* tends to retain the shuttle piece 16*a* at the center of the blade 52, with respect to movement of the shuttle piece 16*a* in either of two opposite directions; the same is true of the other two spring fingers 50 and the elevator blades 54 on the underside of the cover member 14*a*. For sliding movement in one or the other of two opposed directions: In the case that the cover member and shuttle piece move together, the user would initially feel increasing resistance while sliding them. Thereafter as the spring fingers 50 approach the ends of the respective elevator blades 52 on the base member 12*a*, the user would encounter less resistance toward sliding and eventually no resistance prior to halting of the cover member 14*a* and shuttle piece 16*a*. The action is similar to that of the magnetic arrangement described in the first embodiment.

For sliding movement in an orthogonal direction with respect to that just described in the previous paragraph, a similar reaction would be felt by the user; that is he would initially feel increasing resistance while sliding the cover member 14*a* on the shuttle piece 16*a* away from center with respect to the shuttle piece, and thereafter as the spring fingers 50 approach the ends of the respective elevator blades 52 on the shuttle piece 16*a*, the user would encounter still less resistance, until the cover member was halted.

By incorporating the spring fingers entirely in the shuttle piece, a simpler construction is realizable. Similarly, simultaneously with the molding of the base member and cover member, the elevator blades can be included on both, so as to complete the all-plastic detent mechanism.

From the above it can be seen that we have provided a novel and improved, four-way sliding compact construction which is simple in its structure and easy to use. The provision of a large number of individual product wells enables a multiplicity of different shades of cosmetic substance/cosmetic utensils to be stored.

Moreover, all stored materials are readily accessed by a simple, relative sliding movement of cover and base. When not in use, magnet-type centering or plastic finger-type centering can be used, to avoid inadvertently spilling of the articles/substances carried by the compact.

The disclosed arrangements are thus seen to represent a distinct advance and improvement in the cosmetic field.

Each and every one of the appended claims defines an aspect of the invention which is separate and distinct from all others, and accordingly it is intended that each claim be treated as such when examined in any determination of novelty or validity.

Variations and modifications are possible without departing from the spirit of the invention, and portions of the improvement can be used without others.

LIST OF REFERENCE NUMERALS

10 Cosmetic compact
12 Base member
12*a* Base member
14 Cover Member
14*a* Cover Member
12*i* Decorative panel insert for cover member
16 Shuttle piece
16*a* Shuttle piece
18 Base member's expansive bottom wall
18*a* Base member's expansive bottom wall
20 Product/Utensil/Mirror compartments
20*a* Product/Utensil/Mirror compartments
22 Lattice work forming top plane of base member
22*a* Lattice work forming top plane of base member
24 Rails on base member
24*a* Rails on base member
26 Beads on rails 24
26*a* Beads on rails 24*a*
28 Opposite longitudinal edges of shuttle piece
28*a* Opposite longitudinal edges of shuttle piece
30 Upper face of shuttle piece
30*a* Upper face of shuttle piece
32 Rails on upper face of shuttle piece
32*a* Rails on upper face of shuttle piece
34 Beads on rails 32
34*a* Beads on rails 32*a*
36 Additional rails depending from underside of cover member
36*a* Additional rails depending from underside of cover member
38 Cover member depending flanges
38*a* Cover member depending flanges
40 Cover member expansive top wall
40*a* Cover member expansive top wall
42 Magnet/ferro metal
44 Magnet
46 Magnet/ferro metal
50 Spring fingers
52 Upwardly extending elevator blades on base
54 Downwardly extending elevator blades on underside of cover member

What is claimed is:

1. A cosmetic compact, comprising in combination:
a) an expansive base member having a series of upwardly-facing product wells to accommodate one or more cosmetic substances or cosmetic articles, respectively,
b) a cover member, and
c) an expansive shuttle piece interposed between the base member and cover member, said shuttle piece and base member having cooperable slide bearing means for enabling the shuttle piece to slide in opposite directions with respect to the base member,
d) said shuttle piece and cover member having additional cooperable slide bearing means for enabling the cover member to slide in opposite directions with respect to the shuttle piece and base member, said first cooperable slide bearing means and said additional cooperable slide bearing means enabling the cover member to undergo universal sliding movement with respect to the base member.

2. The invention as set forth in claim 1, wherein:
a) said cover member and said base member are substantially the same size, and wherein said product wells of the base member are concealed when the cover member occupies a position overlying the base member.

3. The invention as set forth in claim 1, wherein said additional cooperable slide bearing means for the cover member and shuttle piece comprises a pair of substantially parallel, depending rails on the cover member, and a pair of cooperable, substantially parallel, upstanding rails on the shuttle piece engageable with said cover member rails, respectively, whereby the cover member can slide along the shuttle piece.

4. The invention as set forth in claim 1, wherein the cover member has a top expansive wall and four depending peripheral walls, and wherein two of said four walls which are opposite one another come into engagement with the ends of said base member rails when the cover member is laterally shifted, to limit movement of the cover member with respect to the base member, to either of two desired, predetermined open positions.

5. The invention as set forth in claim 1, wherein:
a) said cover member and said base member are substantially the same size, and wherein one or more of said product wells of the base member become accessible when the cover member is shifted to a position laterally offset with respect to the base member.

6. The invention as set forth in claim 5, wherein:
a) others of said product wells of the base member become accessible when the cover member is shifted to a position that is laterally offset in a perpendicular direction to said first-mentioned lateral offset with respect to the base member.

7. The invention as set forth in claim 1, and further including cooperable means on said base member and said cover member, for biasing the cover member to a position centralized over the base member.

8. The invention as set forth in claim 7, wherein said biasing means comprises one or more magnets and/or ferro-metal parts fastened to the base member and to the cover member, respectively, and a magnet disposed on said shuttle piece.

9. The invention as set forth in claim 1, wherein said first mentioned cooperable slide bearing means for the base member and shuttle piece comprises a pair of substantially parallel upstanding rails on the base member, and formed edge structures on the shuttle piece engageable with said upstanding rails respectively, whereby the shuttle piece can slide in opposite directions with respect to the base member.

10. The invention as set forth in claim 9, wherein the rails on the base member both have coextensive, inwardly facing beads which cooperate with said formed edge structures on the shuttle piece to retain the latter captive during sliding on the base member.

11. The invention as set forth in claim 10, wherein the cover member has a top expansive wall and four depending peripheral walls, and wherein two of said four walls which are opposite one another can come into broadside engagement, one at a time, with one of said rails on the base member when the cover member is laterally shifted, to limit movement of the cover member with respect to the base member, to either of two desired, predetermined open positions.

12. The invention as set forth in claim 1, and further including cooperable means on said base member and said cover member, for biasing the shuttle piece to a position centralized over the base member, and wherein said biasing means comprises a pair of spaced apart, upstanding contoured elevator blades on the base member and a cooperable pair of spring fingers disposed on the shuttle piece, engageable respectively with said elevator blades.

13. The invention as set forth in claim 12, and wherein one spring finger is associated with each elevator blade, and wherein the maximum deflection of each spring finger occurs at two spaced points measured from the center of its respective elevator blade.

14. The invention as set forth in claim 1, and further including cooperable means on said cover member and said shuttle piece, for biasing the cover member to a position centralized over the shuttle piece, and wherein said biasing means comprises a pair of spaced apart, contoured elevator blades depending from the cover member and a cooperable pair of spring fingers disposed on the shuttle piece, engageable respectively with said elevator blades.

15. The invention as set forth in claim 14, and wherein one spring finger is associated with each elevator blade, and wherein the maximum deflection of each spring finger occurs at two spaced points measured from the center of its respective elevator blade.

* * * * *